US005791862A

United States Patent [19]

Ohtsuki et al.

[11] Patent Number: 5,791,862

[45] Date of Patent: Aug. 11, 1998

[54] SUSPENSION SUPPORT DEVICE FOR AN OUTER WALL WORKING MACHINE

[75] Inventors: Shigeru Ohtsuki; Masahiro Michikoshi; Mitsuru Kawahara; Huang Jian Jun, all of Tokyo, Japan

[73] Assignee: Nihon Biso Co., Ltd., Japan

[21] Appl. No.: 819,926

[22] Filed: Mar. 18, 1997

[30] Foreign Application Priority Data

Mar. 25, 1996 [JP] Japan ..... 8-094868

[51] Int. Cl.[6] ..... A47L 1/02

[52] U.S. Cl. ..... 414/663; 15/103; 414/633

[58] Field of Search ..... 15/103; 414/10, 414/11, 630, 631, 633, 637, 662, 663, 744.2, 744.5

[56] References Cited

U.S. PATENT DOCUMENTS 3,497,902 3/1970 Hartigan ..... 15/103 X
3,803,656 4/1974 Fannon, Jr. ..... 15/302

FOREIGN PATENT DOCUMENTS 1428414 3/1969 Germany .
4404797 8/1995 Germany .
4423797 1/1996 Germany .
53-135173 11/1978 Japan ..... 15/103
1557640 12/1979 United Kingdom .

*Primary Examiner*—Janice L. Krizek
*Attorney, Agent, or Firm*—Hedman, Gibson & Costigan, P.C.

[57] ABSTRACT

A suspension support device is provided movably on the upper surface of a building for suspending, by means of ropes, an outer wall working machine having fitting and moving members which can be fittedly engaged in a pair of guide grooves formed vertically on an outer wall surface of the building, and lowering and lifting the outer wall working machine along the guide grooves. The device includes a main body, an arm structure connected to the main body, a holding unit connected to the arm structure in a manner to be movable forwardly and rearwardly, laterally and pivotably about a vertical axis and including a pair of holding guides provided at an interval equal to an interval of the pair of guide grooves and being capable of receiving the fitting and moving members, an arm structure drive unit for driving the arm structure to move the holding unit, sensors for detecting the upper edge of the building, and a drive control system for controlling driving of the arm structure drive unit in response to detection information supplied by the sensors. The drive control system controls driving of the arm structure in response to detection information supplied by the sensors to move the holding unit to a position at which the holding guides align with the guide grooves.

3 Claims, 16 Drawing Sheets

SUSPENSION SUPPORT DEVICE FOR AN OUTER WALL WORKING MACHINE

BACKGROUND OF THE INVENTION

This invention relates to a suspension support device for outer wall working machines such as an automatic work unit and a manned cage working on an outer wall of a building capable of suspending an outer Wall working machine from a roof of a building by means of ropes and lifting and lowering the outer wall working machine along guide grooves formed on the outer wall by taking up and feeding out the ropes.

In performing work such as new building work, repair and cleaning on an outer wall surface of a building, it is known to lift and lower an automatic machine or a manned cage suspended from the roof by means of ropes along the outer wall surface and perform the work by the automatic machine or a workman in the cage.

As the height of a building increases, an outer wall working machine tends to be influenced by wind with resulting sway in lifting or lowering of the working machine. Moreover, the working machine tends to move away from the outer wall surface due to reaction from the wall surface. For preventing this, there is provided a device according to which guide grooves made in the form of channel steel are formed in the moving direction of the working machine, i.e., in a vertical direction, on the outer wall surface of the building and fitting and moving members (i.e., rollers) which are fittedly engaged in these guide grooves are mounted on the working machine. By causing these fitting and moving members to move in the guide grooves, the working machine is guided along the guide grooves and also is prevented from moving away from the outer wall surface.

The fitting and moving members are normally provided on both sides of the outer wall working machine whereas the guide grooves are formed with an interval which is equal to the interval between the two fitting and moving members. By this arrangement, the outer wall working machine performs work while it moves down with the fitting and moving members fitted in the guide grooves on both sides of the working machine. After completion of the work, the working machine is lifted until the fitting and moving members come out of engagement with the guide grooves and then the working machine is moved to a next work area. Then, the fitting and moving members of the working machine are fittedly engaged in the guide grooves of the new work area and a next work is started.

In the schematic side elevation of FIG. 19, a support device 70 is provided movably along rails 2 laid along an outer wall on the roof of a building 1. In a main body 71 of the device 70 is provided a winder (not shown) for taking up and feeding out ropes 4 for suspending an outer wall working machine 40. A holding unit 72 is also provided in the main body 71 through an arm 73 for holding the working machine 40.

The holding unit 72 includes a pair of holding guide members 72A provided with an interval equal to the interval between a pair of guide grooves 3 formed on the building 1 (i.e., the interval between the fitting and moving members 41 of the working machine 40). By lifting the working machine 40 up to the location of the holding unit 72 and causing the fitting and moving members 41 to engage fittedly in the holding guide members 72A, the working machine 40 is held stably by the holding unit 72.

The holding guide members 72A have the same cross section as the guide grooves 3 of the building 1 and are long enough to receive the fitting and moving members 41. The lower end portions of the holding guide members 72A are formed so as to have a predetermined interval between the upper surface of the building 1 and are provided with connecting members 72C which are driven by drive means 72B such as a motor cylinder to project from and withdraw into the holding guide members 72A.

In the projecting state, the connecting members 72C connect the holding guide members 72A with the guide grooves 3 of the building 1 and thereby guide the fitting and moving members 41 to move smoothly between the guide grooves 3 and the holding guide members 72A.

The ropes 4 suspending the outer wall working machine 40 extend from the winder in the main body 71 to the holding unit 72 via the arm 73 and are suspended from the upper portion of the holding unit 72.

According to this support device 70, the outer wall working machine 40 is lowered and lifted by feeding out and taking up of the ropes 4 by the winder and, as shown in FIG. 20, the working machine 40 is held by the holding unit 72 by causing the fitting and moving members 41 of the working machine 40 to engage in the holding guide members 72A whereby an area in which the working machine is lowered and lifted (i.e., a working area of the working machine 40) can be changed with the working machine held by the holding unit 72.

More specifically, the working machine 40 is lifted from the state in which the fitting and moving members 41 are fittedly engaged in the guide grooves 3 to the state in which the fitting and moving members 41 are engaged in the holding guide members 72A of the holding unit 72 (at this time, the connecting members 72C are in the projecting state and connect the holding guide members 72A with the guide grooves 3). Then, the connecting members 72C are withdrawn and the support device 70 is moved along the rails 2 to a position where the holding guide members 72A of the holding unit 72 oppose desired guide grooves 3 while holding the working machine 40 in the holding unit 72. The connecting members 72C are now driven to project to connect the holding guide members 72A with the guide grooves 3 and the working machine 40 is lowered to shift the fitting and moving members 41 from the holding guide members 72A to the guide grooves 3 whereby the working machine 40 can be lowered along the guide grooves 3.

In the above described prior art support device 70, positioning for aligning the holding guide members 72A of the holding unit 72 with the guide grooves 3 is made by stopping the support device 70 at a predetermined position on the rails 2. More specifically, a sensor is provided either on the rails 2 or the support device 70 and a member to be detected by the sensor is provided on the other. The holding guide members 72A of the holding unit 72 are intended to align with the guide grooves 3 by stopping the support device 70 at a position where the sensor has detected the member to be detected. It has, however, been found difficult to align, with a high accuracy, the holding guide members 72A with the guide grooves 3 with such a positioning method and, as a result, there often occurs a case where the working machine 40 held by the holding guide members 72A cannot be shifted to the guide grooves 3 or, conversely, a case where the working machine 40 cannot be received from the guide grooves 3 to the holding guide members 72A.

Further, there is a case where structure of a building prevents rails from being laid along the outer wall surface of the building. In such building, positioning of the holding guide members 72A to the guide grooves 3 becomes further difficult.

Furthermore, the structure for projecting and withdrawing the connecting members 72C which connect the holding guide members 72A with the guide grooves 3 by the drive means 72B is complicated and costly.

It is, therefore, an object of the invention to provide a suspension support device for an outer wall working machine capable of performing positioning of the holding guide members of the holding unit to the guide grooves with a high accuracy and also having simplified and inexpensive connecting members which connect the holding guide members with the guide grooves.

SUMMARY OF THE INVENTION

For achieving the above described object of the invention, there is provided a suspension support device provided movably on the upper surface of a building for suspending, by means of ropes, an outer wall working machine having fitting and moving members which can be fittedly engaged in a pair of guide grooves formed vertically on an outer wall surface of the building, and lowering and lifting the outer wall working machine along the guide grooves comprising a main body, an arm structure connected to the main body, a holding unit connected to the arm structure in a manner to be movable forwardly and rearwardly, laterally and pivotable about a vertical axis and including a pair of holding guide members provided at an interval equal to an interval of the pair of guide grooves and being capable of receiving the fitting and moving members, arm structure drive means for driving the arm structure to move the holding unit, sensor means provided at both sides of the holding unit at positions corresponding to the holding guide members for detecting the upper edge of the building, and drive control means for controlling driving of the arm structure drive means in response to detection information supplied by the sensor means, said drive control means controlling driving of the arm structure to move the holding unit in a direction perpendicular to the outer wall surface while maintaining the posture of the holding unit, calculate angle and position of the holding unit with respect to the outer wall surface in response to the detection information concerning the outer wall surface supplied by the sensor means, move the holding unit to a position which is parallel to the outer wall surface and coincidental with the guide grooves in a direction perpendicular to the outer wall surface and thereafter move the holding unit in a direction parallel to the outer wall surface in a horizontal plane while maintaining the posture of the holding unit and, responsive to the detection information concerning the guide grooves supplied by the sensor means, bring the holding unit to a position at which the holding guide members align with the guide grooves.

According to the invention, the holding guide members of the holding unit can be positioned, with a high accuracy, to the guide grooves formed on the outer surface of the building whereby the outer wall working machine held by the holding unit can be shifted smoothly to the guide grooves and, conversely, the outer wall working machine located on the guide grooves can be shifted smoothly to the holding unit.

In one aspect of the invention, the lower ends of the holding guide members of the holding unit are spaced from the upper edge of the building by a predetermined distance and said holding unit further comprises connecting members provided vertically slidably in the lower portion of the holding guide members to project from and withdraw into the holding guide members and thereby connect and disconnect the holding guide members with the guide grooves of the building and said holding unit further comprises actuator means connected to the connecting members, said connecting members being withdrawn into the holding guide members by operation of the actuator means by the outer wall working machine when the outer wall working machine is lifted and held by the holding guide members and said connector members projecting from the holding guide members when the outer wall working machine is lowered from the holding guide members to the outer wall surface of the building and thereby connecting the holding guide members with the guide grooves.

According to this aspect of the invention, since the connecting members connecting the holding guide members with the guide grooves are operated by the outer wall working machine in such a manner that, when the outer wall working machine is lifted and held by the holding unit, the connecting members are withdrawn and received in the holding guide members and, when the outer wall working machine is lowered from the holding unit to the building side, the connecting members project and connect the holding guide members with the guide grooves as the outer wall working machine is lowered, the structure of the connecting members can be simplified and manufacturing cost thereby can be reduced.

In another aspect of the invention, said holding unit further comprises a spring provided between the connecting members and the actuator means for permitting, by elastic deformation of the spring, vertical movement of the outer wall working machine in a state where the connecting members are withdrawn and received in the the holding guide members.

According to this aspect of the invention, vertical movement of the outer wall working machine can be permitted when the outer wall working machine is lifted or lowered by operation of the arm structure in a state where the outer wall working machine is held by the holding unit.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Figure 1:
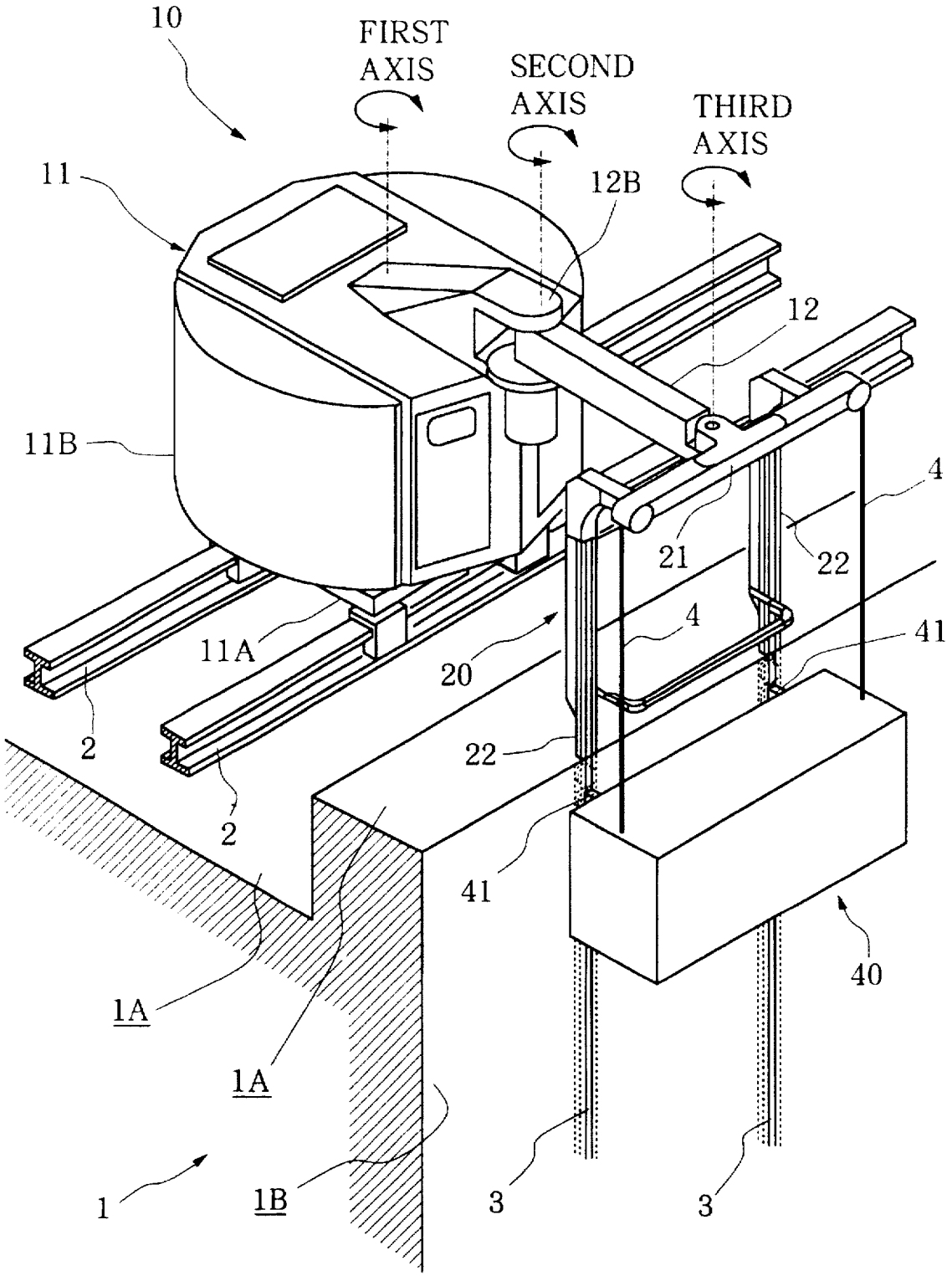
FIG. 1 is a perspective view showing an embodiment of a suspension support device for an outer wall working machine made according to the invention in a state suspending an outer wall working machine.
Figure 2:
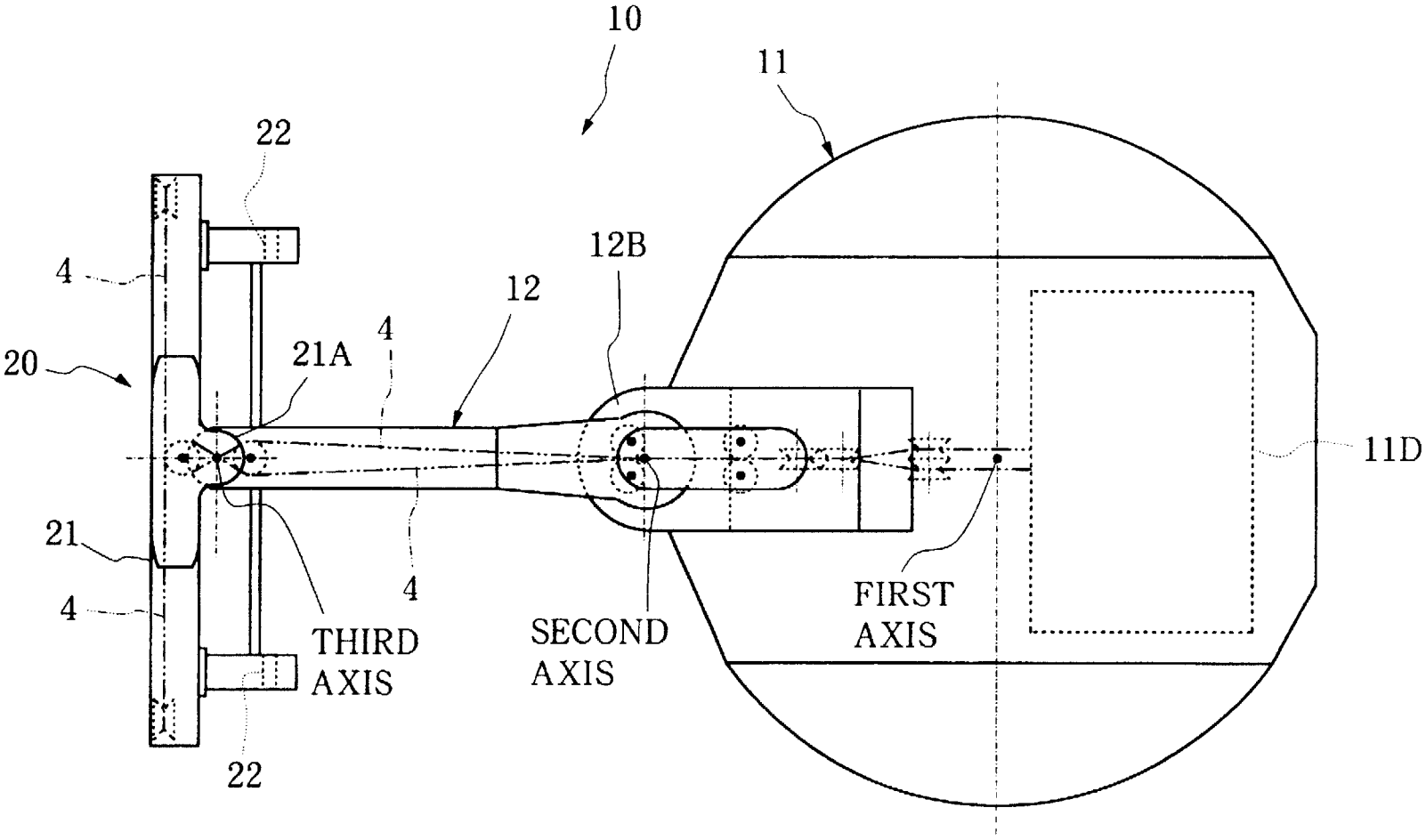
FIG. 2 is a plan view of the device of FIG. 1.

A suspension support device 10 has a movable body 11 which is movable along rails 2 laid on a roof (upper surface 1A) of a building 1, a holding unit 20 connected to a pivotable arm 12 which constitutes the arm structure. An outer wall working machine 40 is suspended and supported by wire ropes 4 which are suspended vertically from the holding unit 20.

The wire ropes 4 suspending the outer wall working machine 40 extend from a winding device 11D provided in a rotary body 11B of the movable body 11 through the inside of the pivotable arm 12 and inside of a lateral arm 21 of the holding unit 20 and are suspended from end portions of the lateral arm 21 and are connected to sides of the outer wall working machine 40 to support the working machine 40.

The outer wall working machine in this embodiment is an automatic machine for automatically performing a window cleaning work. Although illustration of details of the working machine 40 is omitted, the working machine 40 has fitting and moving members 41 having plural rollers arranged in parallel on left and right end portions of a surface opposite to an outer wall surface 1B of the building 1. These fitting and moving members 41 can be fittedly engaged in vertical guide grooves 3 formed on the outer wall surface 1B of the building 1. As the rollers of the fitting and moving members 41 are rotated, the outer wall working machine 40 suspended by the wire ropes 4 is lifted or lowered, being guided along the guide grooves 3.

The pair of the guide grooves 3 have an interval which is equal to a lateral interval of the pair of fitting and moving members 41. The guide grooves 3 have a generally rectangular cross section with one side thereof opened outwardly like channel steel bars buried in the surface portion of the outer wall and the fitting and moving members 41 of the outer wall working machine 40 can be fittedly engaged in the guide grooves 3 in such a manner that the fitting and moving members 41 cannot move forward and rearward or leftward and rightward but can move vertically. The guide grooves 3 are formed at the upper edge portion of the building 1 with connecting openings 3A having an upwardly increasing taper.

The suspension support device 10 will now be described more in detail.

The movable body 11 has a wheel unit 11C which engages with the rails 2 laid on the upper surface 1A of the building 1, a running base 11A including a drive mechanism (not shown) for driving the wheel unit 11C, and the rotary body 11B of a columnar configuration which constitutes the main body of the suspension support device 10 including the winding device 11D for taking up and feeding out the wire ropes 4. The rotary body 11B is mounted on the running base 11A rotatably about a vertical axis (first axis).

Figure 3:
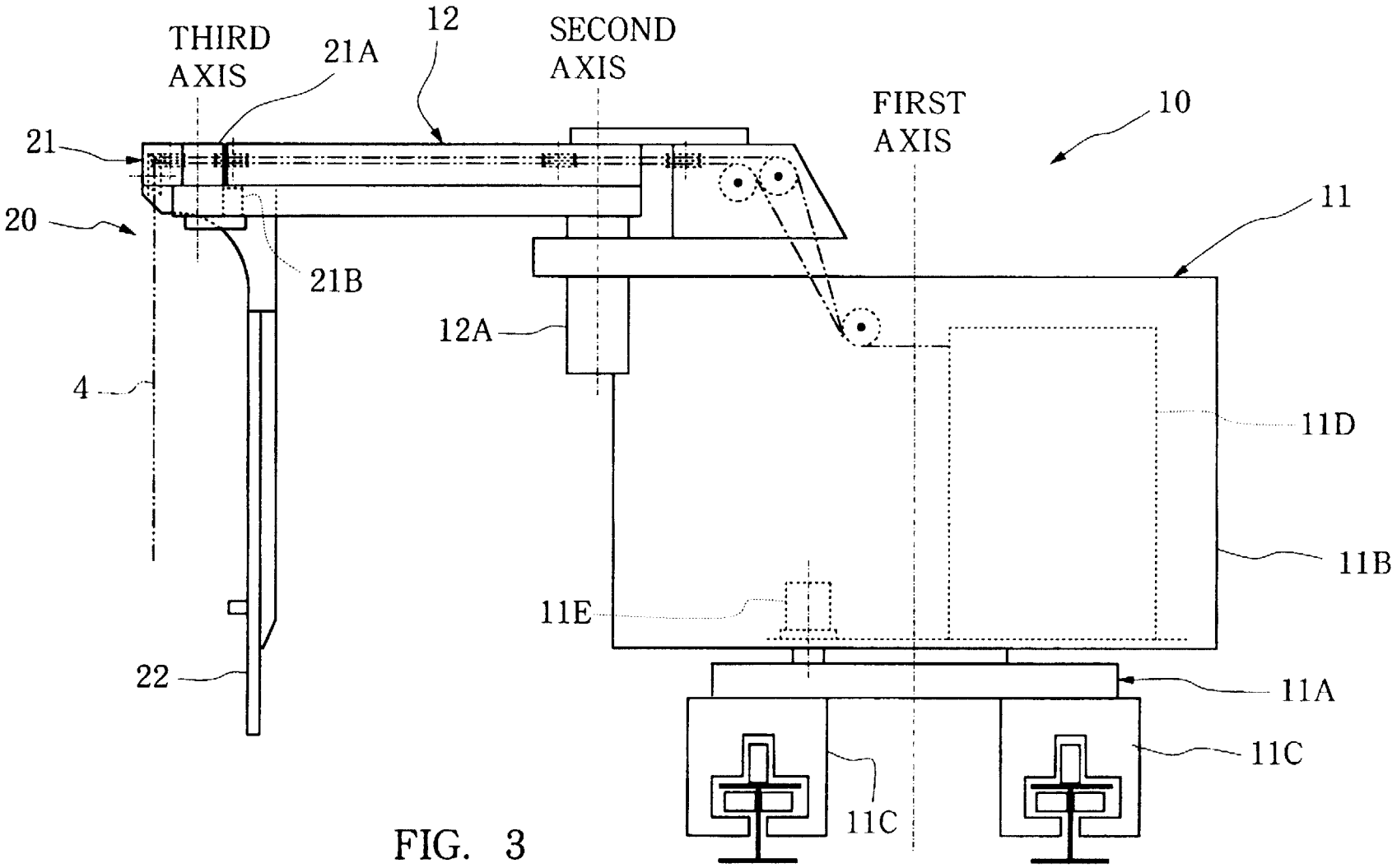
FIG. 3 is a right side elevation of the device.
Figure 6:
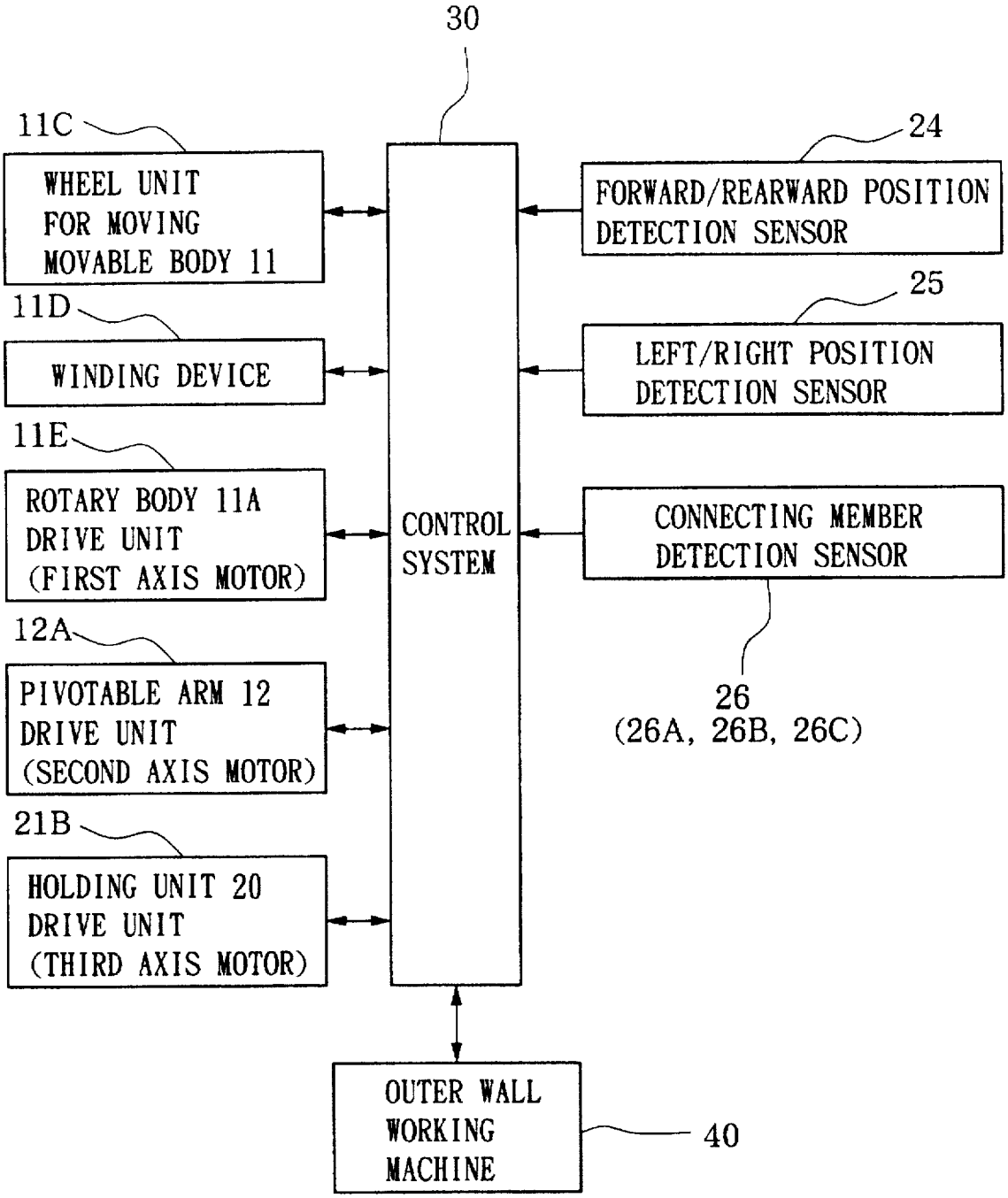
FIG. 6 is a block diagram showing a control system.

The rotary body 11B is driven and rotated by a first axis motor 11E (FIG. 3) such as a servo motor including position and speed detectors. This first axis motor 11E is, as shown in the control system of FIG. 6, driven by a control system 30 and, therefore, the rotary body 11B is driven and rotated by the control system 30.

Driving of the wheel unit 11C connected to the running base 11A and the winding device 11D provided in the rotary body 11B are also controlled by the control system 30 and, therefore, the control system 30 controls movement of the movable body 11 along the rails 2 (i.e., movement of the suspension support device 10 along the rails 2) and lifting and lowering of the outer wall working machine 40 by taking up and feeding out of the wire ropes 4.

The pivotable arm 12 is pivotably supported about a vertical axis (second axis) at a portion in the vicinity of the upper peripheral portion of the rotary body 11B and supports the holding unit 20 at the foremost end portion thereof. The base of the pivotable arm 12 is inserted in an opening of an arm holding portion 12B provided on the rotary body 11B and having a generally C-shaped cross section and is supported by the arm holding portion 12B pivotably about the second axis in a horizontal plane. The pivotable arm 12 is rotated by a second axis motor 12A such as a servo motor including position and speed detectors.

Driving of this second axis motor 12A is controlled by the control system 30 and, therefore, the pivotable arm 12 is driven and rotated by the control system 30.

The holding unit 20 includes the lateral arm 21 of a predetermined length and a pair of left and right holding guides 22 which constitute the holding guide members which extend vertically downwardly at an interval equal to the interval of the guide grooves 3 of the building 1. The holding unit 20 is supported rotatably about a vertical axis (third axis) at the center of the lateral arm 21 on the foremost end portion of the pivotable arm 12. The holding unit 20 is rotatable by a predetermined angle.

The lateral arm 21 is formed in the central portion thereof with a rearwardly projecting support portion 21A which is supported on the foremost end portion of the pivotable arm 12 rotatably about the third axis and is rotated by a third axis motor 21B.

Driving of this third axis motor 21B is controlled by the control system 30 and, therefore, the holding unit 20 is rotated by the control system 30.

The holding guides 22 are of a relatively small thickness and formed in a cross section which can be fittedly engaged in the guide grooves 3 and have a length which is sufficient for receiving the entire fitting and moving members 41. Connecting members 23 are slidably provided in the lower end portion of the holding guides 22.

Figure 7:
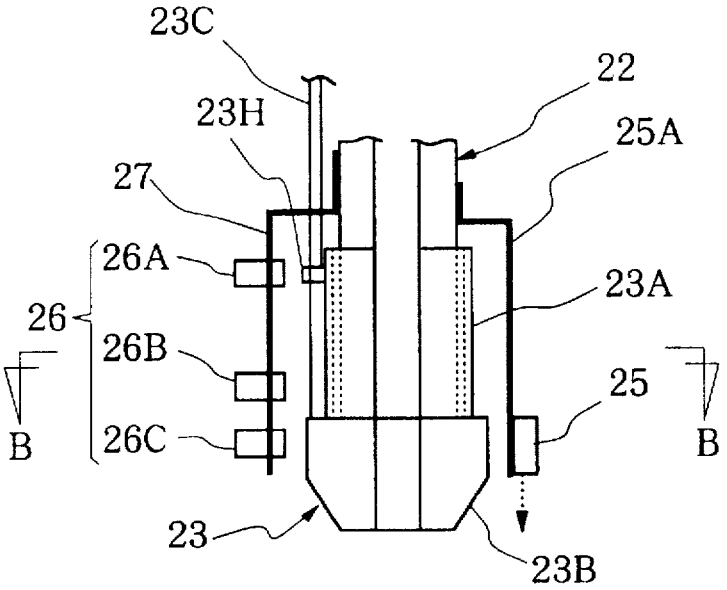
FIG. 7 is an enlarged front view of connecting members of holding guides.
Figure 8:
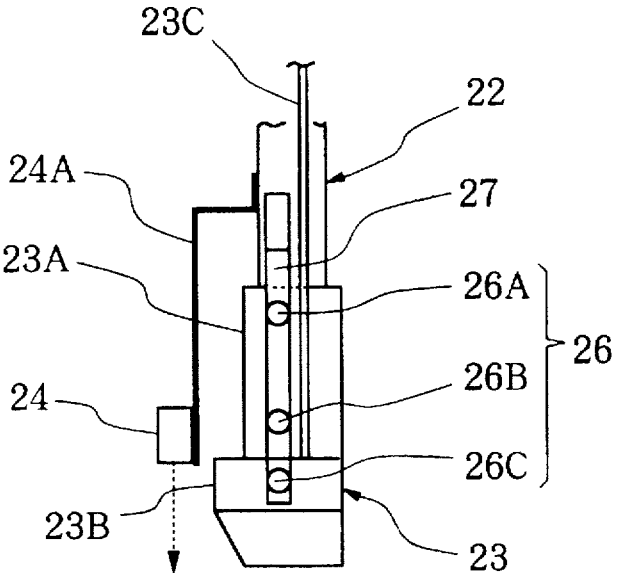
FIG. 8 is a left side elevation of the connecting members shown in FIG. 7.
Figure 9:
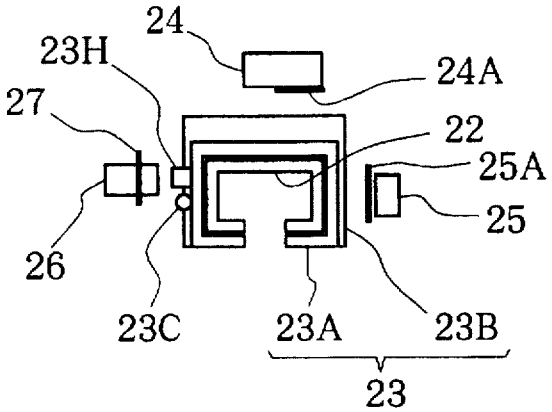
FIG. 9 is a sectional view taken along lines B—B in FIG. 7.

The connecting members 23 each have, as shown in FIGS. 7, 8 and 9, an engaging main body 23A, a connecting portion 23B formed at the lower end of the engaging main body 23A and having a tapered end portion corresponding to the upper end connecting openings 3A of the guide grooves 3, and a slide bar 23C fixed on one side of the connecting members 23. The engaging main body 23A is slidably engaged with the outside surface of the holding guide 22 and the slide bar 23C is slidably engaged in a support guide 22A (FIG. 10) which is fixed on one side of the holding guide 22.

The slide bar 23C has an end stopper 23D fixed at its upper end and a stopper 23E fixed at a location nearer to the middle portion of the slide bar 23C. A coil spring 23F is provided outside of the slide bar 23C between the end stopper 23D and the stopper 23E. An actuating lever 23G in which the slide bar 23C is slidably engaged is provided between the lower end of the coil spring 23F and the stopper 23E and is urged by elastic restoring force of the coil spring 23F to the stopper 23E. The urging force of the coil spring 23F is set at a value which is larger than the entire weight of the connecting member 23 and, therefore, in a normal state, the connecting members 23 can be vertically moved by operating the actuating levers 23G vertically without deforming the coil springs 23F.

Figure 4:
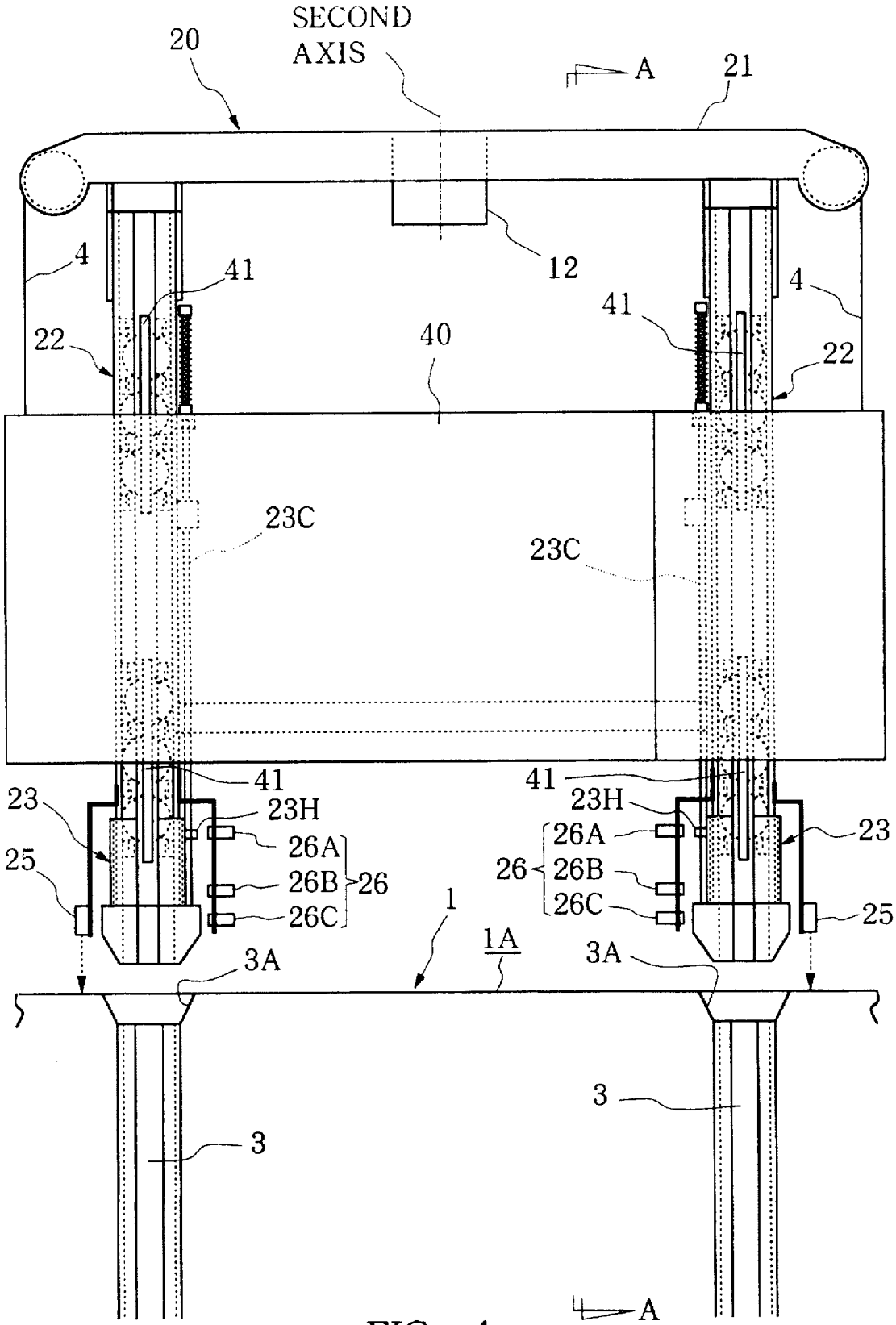
FIG. 4 is a front view of a holding unit.
Figure 5:
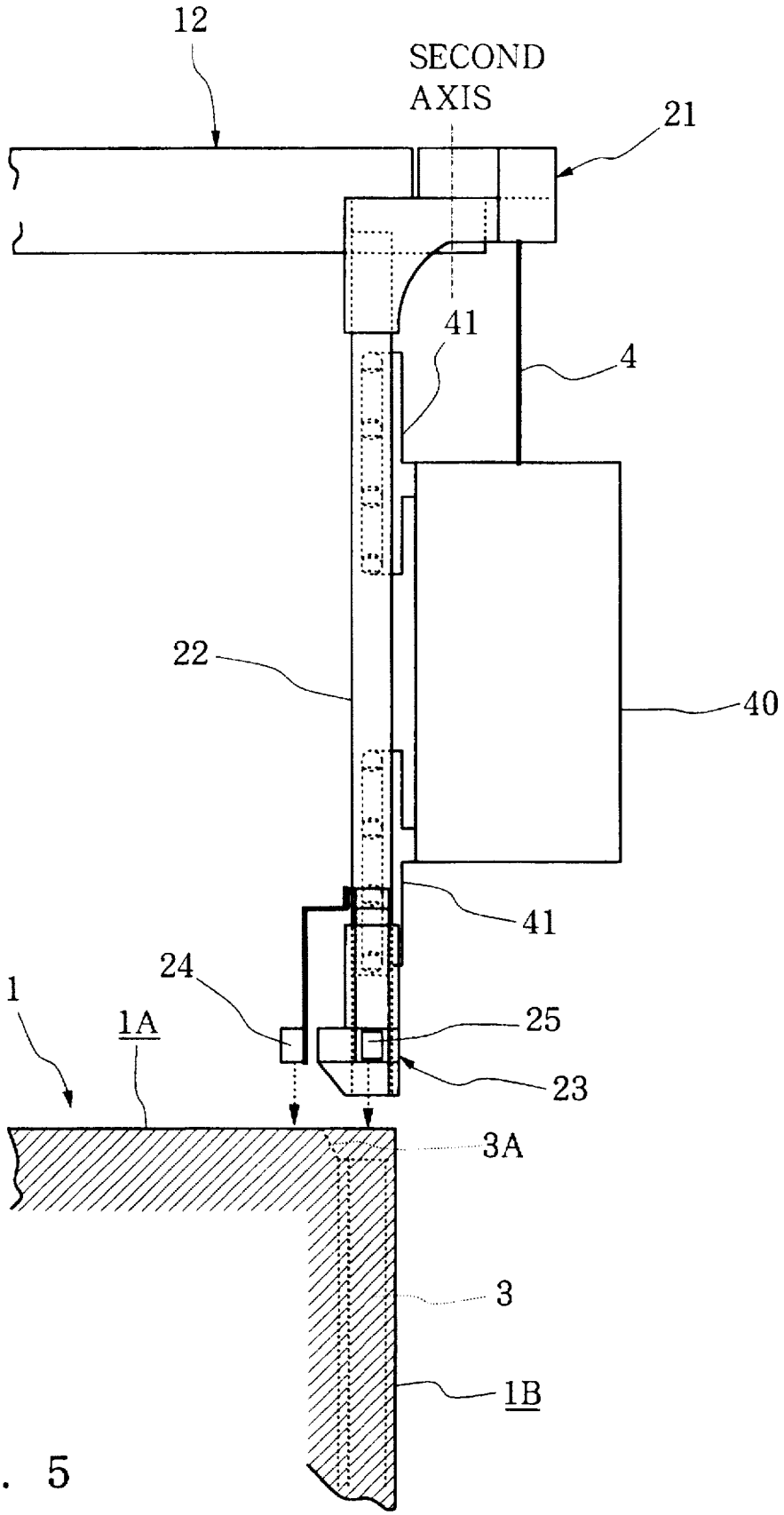
FIG. 5 is a left side elevation of the holding unit shown in FIG. 4.
Figure 10:
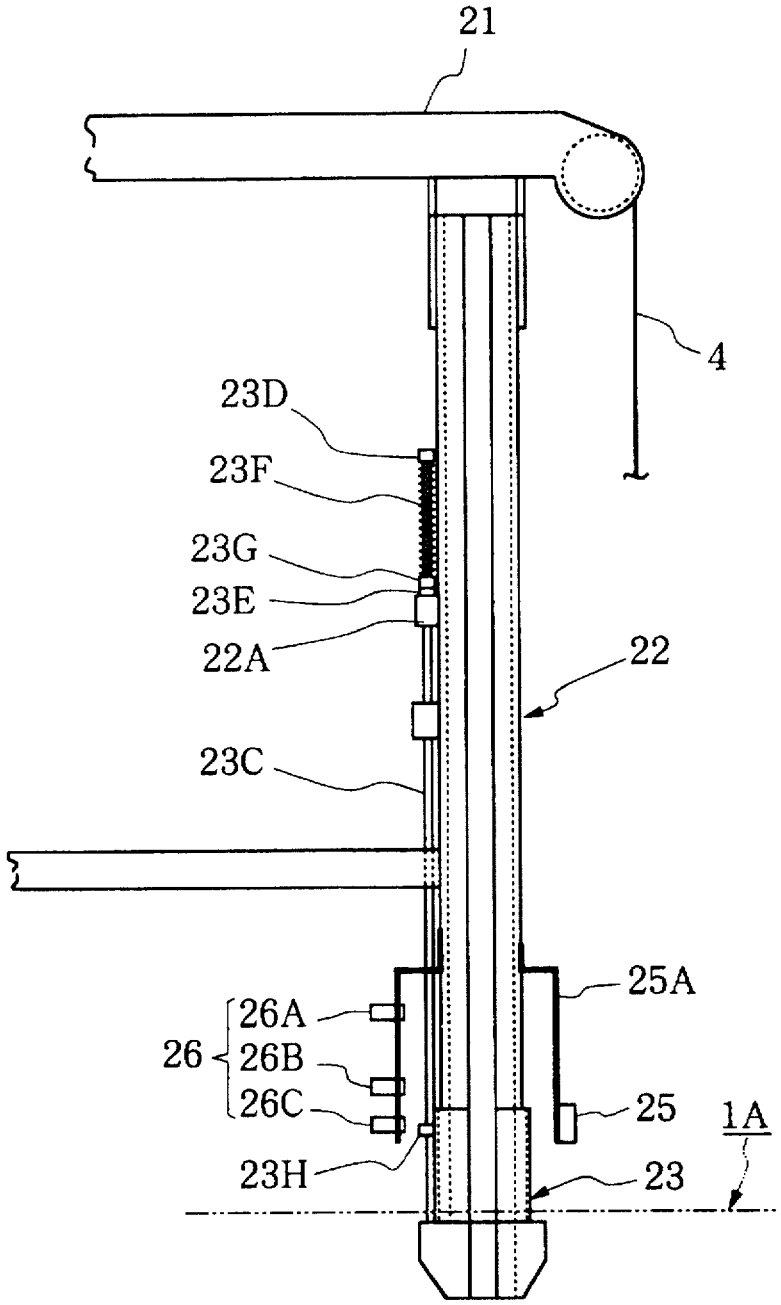
FIG. 10 is a front view of the holding guides with the connecting members projecting to the lowermost position.

The engaging main bodies 23A of the connecting members 23 are slidably engaged with the holding guides 22 to be received on the holding guides 22 or project from the holding guides 22 as described above. The stroke of the sliding movement of the engaging main bodies 23A is so set that, when the engaging main bodies 23A are received on the holding guides 22 (i.e., in a withdrawn state), the lower end surfaces of the connecting portions 23B are located above the upper surface 1A of the building 1 by a predetermined distance as shown in FIGS. 4 and 5 whereas in a projecting state, the lower end surfaces of the connecting portions 23B are located, as shown in FIG. 10, below the upper surface 1A of the building 1 by a predetermined distance.

Figure 11:
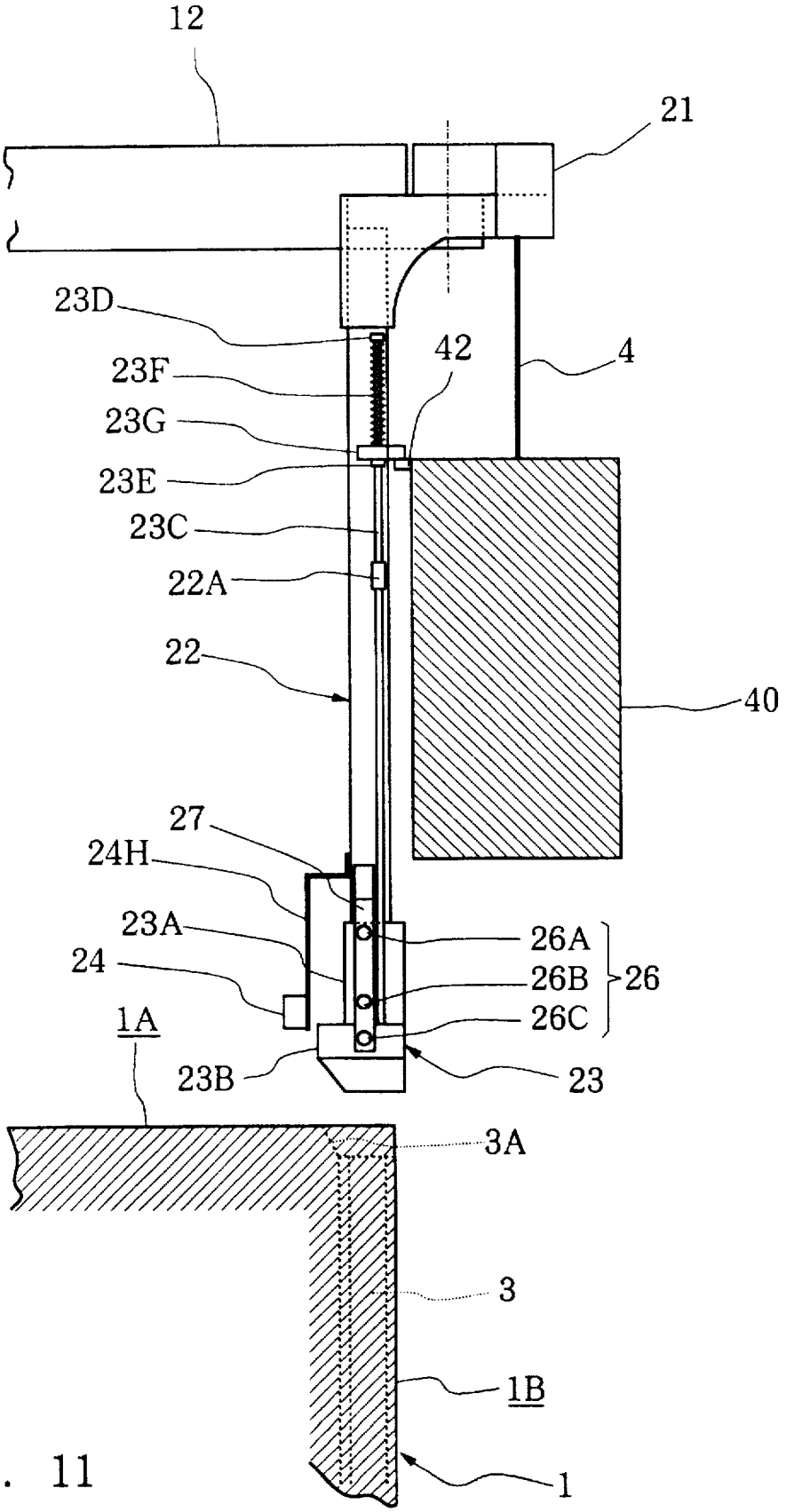
FIG. 11 is a sectional view taken along lines A—A in FIG. 4.

As shown in FIG. 11, the sliding drive of the connecting members 23 is achieved by actuation of the actuating lever 23G of the slide bar 23C by an actuator 42 projecting from the upper end portion on the rear surface of the outer wall working machine 40. More specifically, when the outer wall working machine 40 is to be held by the holding unit 20, the fitting and moving members 41 of the outer wall working machine 40 are engaged in the holding guides 22 of the holding unit 20 and the working machine 40 is lifted to a predetermined position. In the middle of this lifting movement, the actuators 42 of the working machine 40 interfere with the actuating levers 23G (i.e., the connecting members 23) and push up the actuating levers 23G (i.e., the connecting members 23). The sliding stroke is so set that, when the working machine 40 has reached a predetermined position and stops there, the connecting members 23 reach their upper limit position.

When the outer wall working machine 40 is lowered, the actuators 42 are lowered and, therefore, the connecting members 23 are also lowered due to their self-weight to project from the lower ends of the holder guides 22.

In the lower end portions of the holding guides 22, forward and rearward position detecting sensors 24, left and right position detecting sensors 25 and connecting member detection sensors 26 are provided on brackets 24A, 25A and 27, respectively.

Each of the forward and rearward position detection sensors 24 is constructed of a proximity switch and is supported on the bracket 24A fixed on the rear surface of the holding guide 22, facing downward to detect the upper surface 1A of the building 1. When the building 1 is located beneath the forward and rearward position detection sensor 24 (i.e., when the sensor 24 is above the building 1), the sensor 24 supplies a detection signal to the control system 30.

The left and right position detection sensors 25 are constructed of proximity switches and are supported on the brackets 25A fixed to the outer side surfaces of the holding guides 22, facing downward to detect the upper surface 1A of the building 1. When the building 1 is located beneath the left and right position detection sensors 25 (i.e., when the left and right position detection sensors 25 are above the building 1), the sensors 25 supply a detection signal to the control system 30.

The connecting member detection sensors 26 for each of the holding guides 22 consist of three proximity switches 26A, 26B and 26C and are arranged vertically at a predetermined interval on the bracket 27 fixed on the inner side surface of each holding guide 22, facing the the engaging main body 23A of the connecting member 23 to detect a projection 23H provided on the inner side of the engaging main body 23A of the connecting member 23. The sensor 26A is disposed at a position where it detects the projection 23H at the upper limit position of the connecting member 23 and serves as an upper limit detection sensor. The sensor 26B is disposed at a position where it detects the projection 23H when the lower end 23B of the connecting member 23 is engaged in the upper opening 3A of the guide groove 3 of the building 1 and serves as a connection detection sensor. The sensor 26C is disposed at a position where it detects the projection 23H at the lower limit position of the connecting member 23 and serves as a lower limit detection sensor. These sensors 26A, 26B and 26C respectively supply a detection signal to the control system 30 when they have detected the projection 23H.

Figure 16:
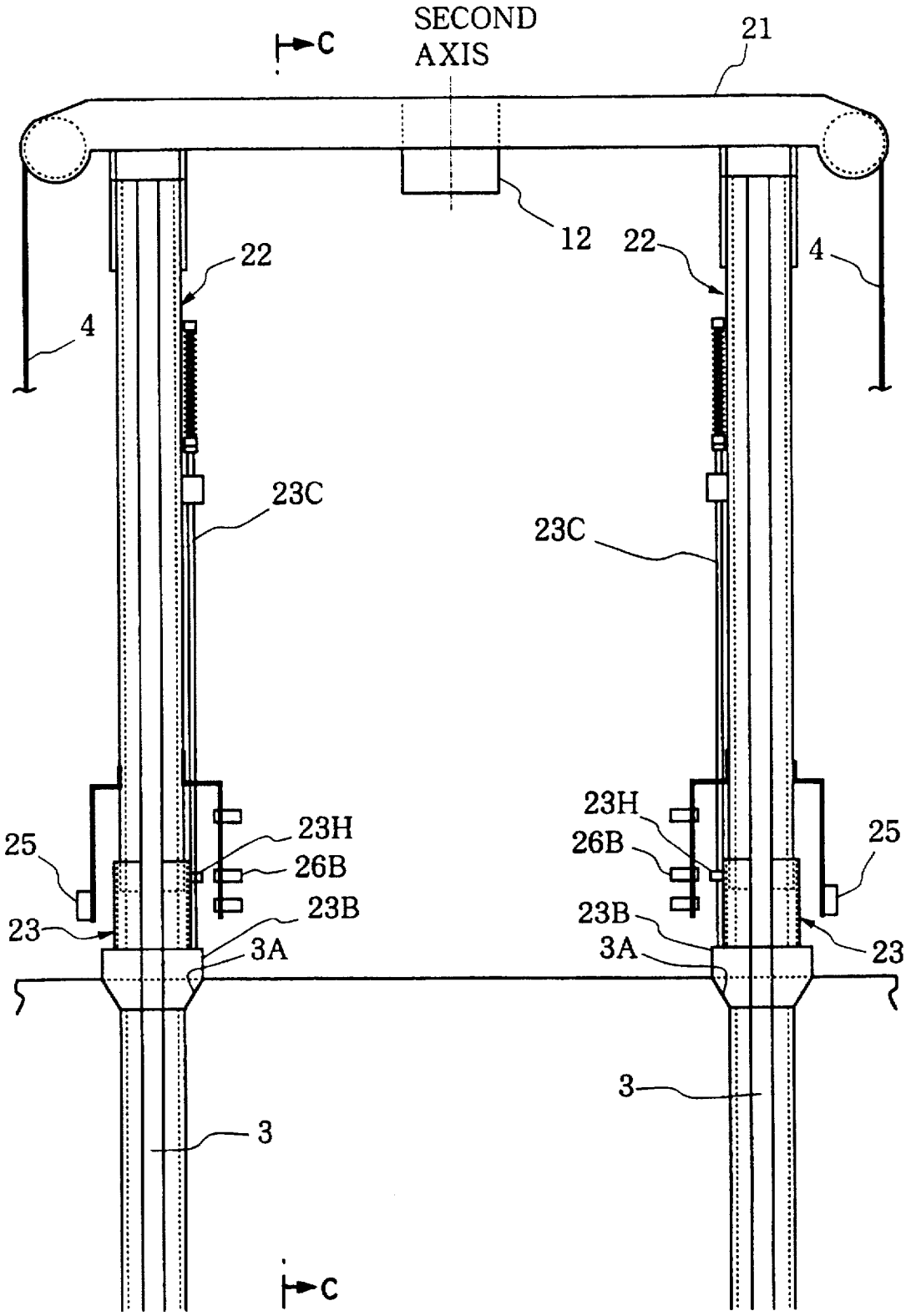
FIG. 16 is a front view showing a state of connection by the connecting members.
Figure 17:
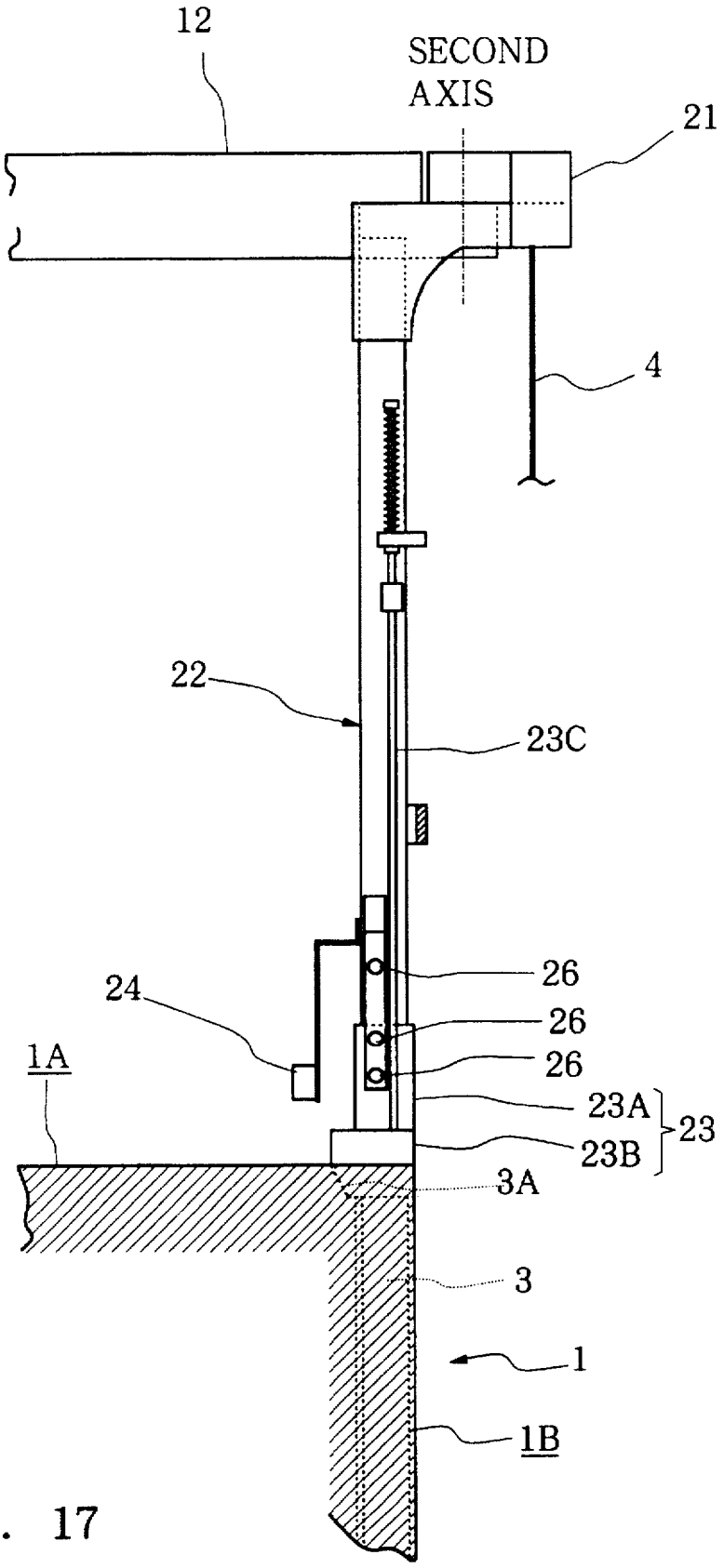
FIG. 17 is a sectional view taken along line C—C in FIG. 16.

By this arrangement, the control system 30 can detect the state of the connecting members 23 upon receipt of a projection 23H detection signal supplied from the connecting member detection sensors 26A, 26B and 26C. More specifically, when the lower limit sensor 26C has detected the projection 23H (i.e., when a detection signal has been supplied from the lower limit sensor 26C), the control system 30 can detect that the connecting member 23 projects from the holding guides 22 to their lower limit position as shown in FIG. 10 and the holding guides 22 are not located above the building 1 (i.e., there is no building 1 beneath the holder guides 22). When the connection sensor 26B has detected the projection 23H, the control system 30 can detect that the connecting portions 23B of the connecting members 23 are engaged in the connecting openings 3A of the guide grooves 3 of the building 1 (i.e., the holding guides 22 are aligned with the guide grooves 3) as shown in FIGS. 16 and 17. When the upper limit sensor 26A has detected the projection 23H, the control system 30 can detect that the connecting members 23 are received on the holder guides 22 to their upper limit position as shown in FIGS. 4 and 5.

The suspension support device 10 of the above described construction can hold the outer wall working machine 40 with its holding unit 20 and also can move the outer wall working machine 40 held by the holding unit 20 to any desired position within a range in which the pivotable arm 12 can reach on a horizontal plane by the movement of the movable body 11 along the rails 2, the rotation of the rotary body 11B about the first axis and the pivotal movement of the pivotable arm 12 about the second axis. The suspension support device 10 can further change the angle of the outer wall working machine on a horizontal plane as desired by the rotation of the holding unit 20 about the third axis. That is, the rotation drive mechanism for the rotary body 11B (the first axis motor 11E), the pivoting drive mechanism for the pivotable arm 12 (the second axis motor 12A) and the rotation drive mechanism for the holding unit 20 (the third axis motor 21B) as a whole constitute the arm structure drive means.

This arm structure drive means is driven, as described above, by the control system 30. Lowering and lifting of the outer wall working machine 40 by taking up and feeding out of the wire ropes 4 by the winding device 11D provided in the movable body 11 are also driven and controlled by the control system 30.

The control system 30 controls the respective drive units of the suspension support device 10 in accordance with a predetermined program as described below to cause the fitting and moving members 41 of the outer wall working machine 40 to engage in the guide grooves 3 of the outer wall surface 1B and lower and lift the working machine 40 along the guide grooves 3 for performing work on the outer wall surface 1B.

Figure 12:
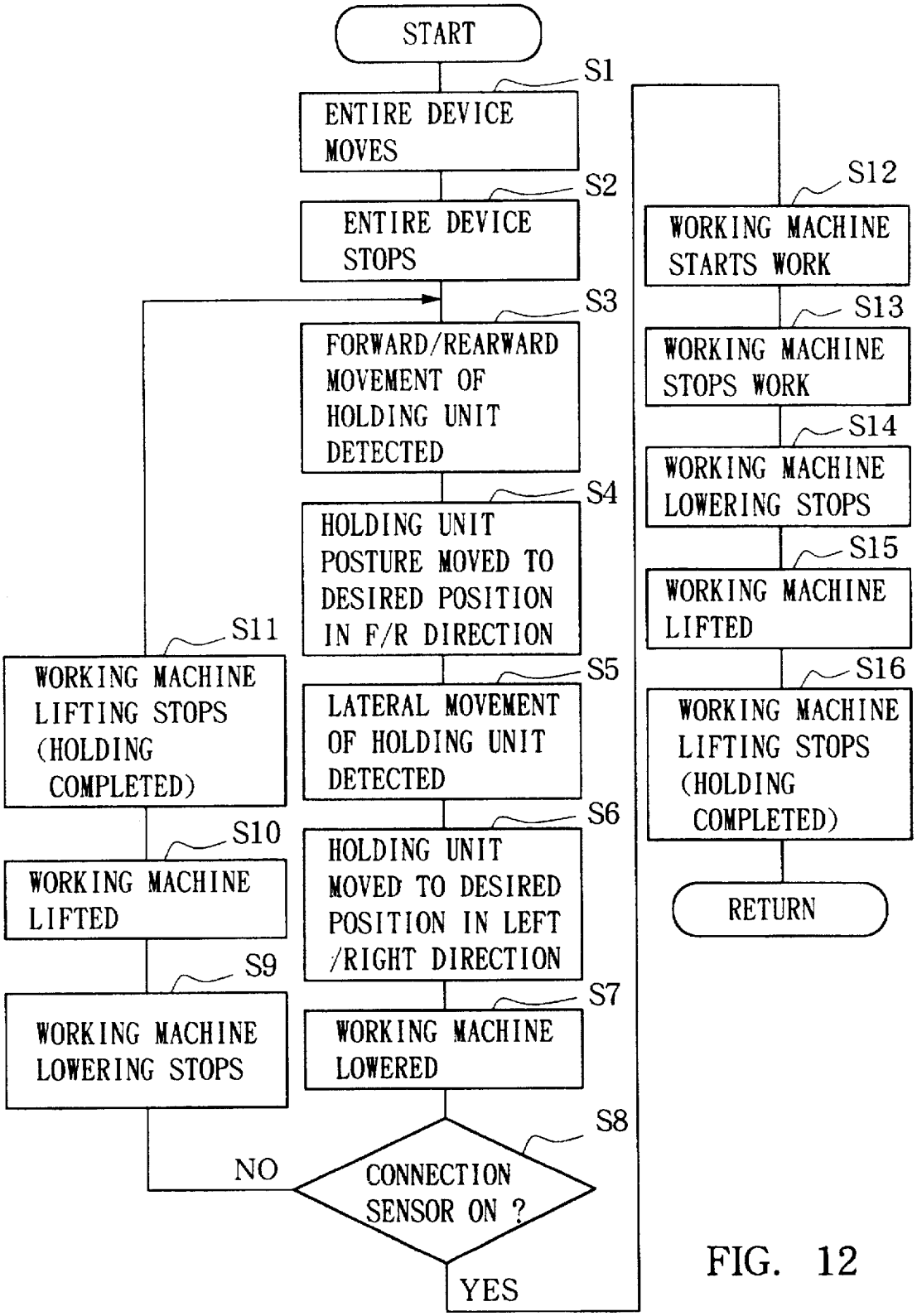
FIG. 12 is a flow chart showing operation of the control system.

The driving control of the suspension support device 10 by the control system 30 will now be described with reference to the flow chart shown in FIG. 12.

First, the suspension support device 10 holding the outer wall working machine 40 is moved from its stand-by position along the rails 2 by driving the wheel unit 11C of the movable body 11 (S1) and stopped at a predetermined position (S2). This stopping at a predetermined position is made by detecting a member to be detected provided on either one of the building 1 and the device 10 by a sensor provided on the other of the building 1 and the device 10.

Then, the holding unit 20 is moved to perform positioning in the forward and rearward direction with respect to the outer wall surface 1B (i.e., in the direction perpendicular to the outer wall surface lB) as well as positioning in the leftward and rightward direction (i.e., in the direction parallel to the outer wall surface 1B).

Figure 13A:
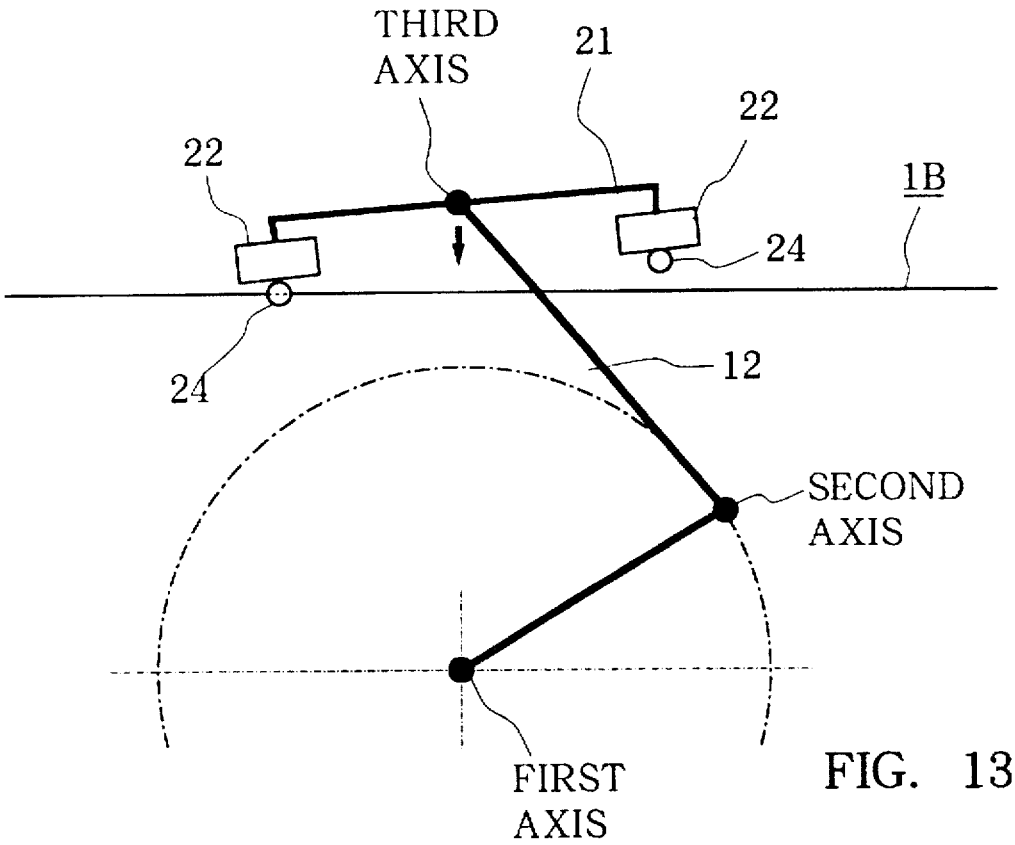
FIGS. 13A and 13B are views for explaining about postures of the device in positioning in the forward and rearward direction and a manner of detecting the position of the device in the forward and rearward direction.
Figure 13B:
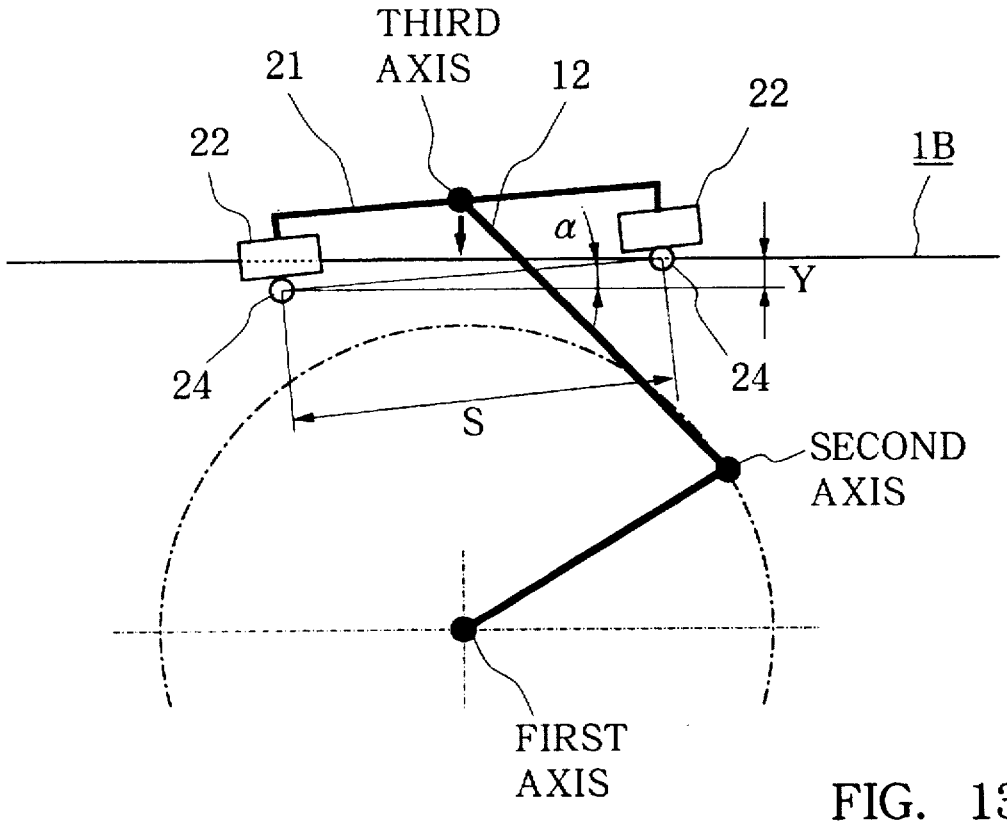
Figure 14:
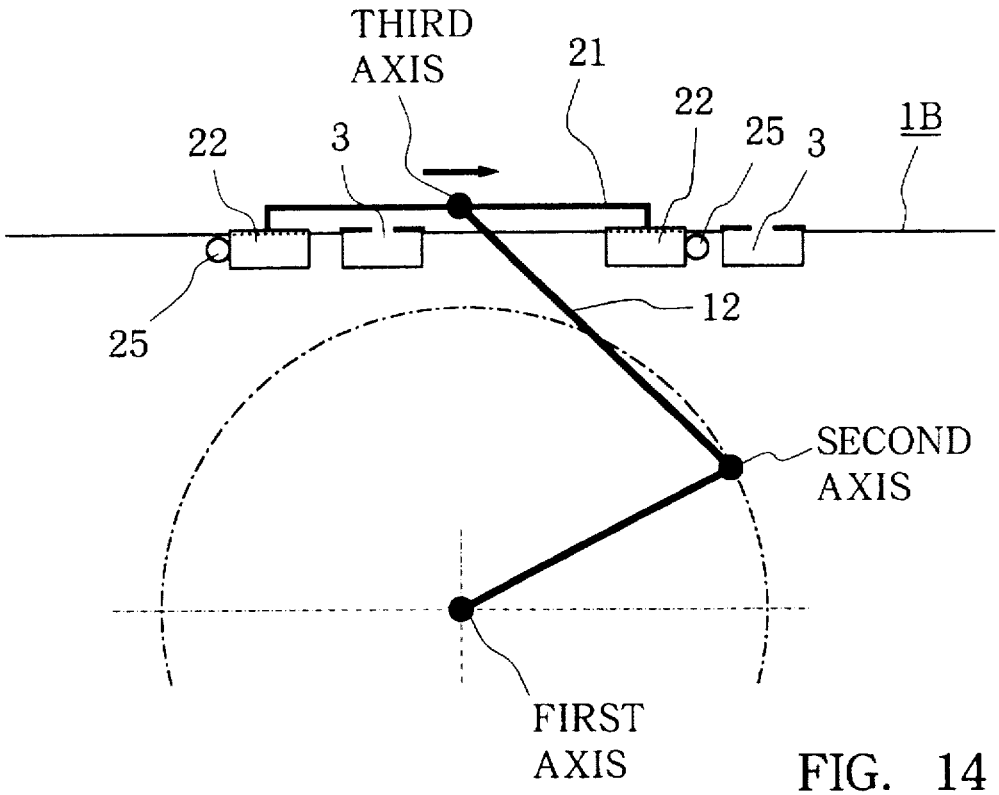
FIG. 14 is a view for explaining about a manner of detecting a position of the device in a lateral direction in lateral positioning.

For positioning of the holding unit 2 in the forward and rearward direction, the holding unit 20 is moved in the direction crossing the outer wall surface 1B of the building 1 while maintaining the posture of the holding unit 20 by rotation of the rotary body 11B about the first axis and pivoting of the pivotable arm 12 about the second axis and, during this movement, relative position of the holding unit 2 (position and angle) of the holding unit 20 with respect to the outer wall surface 1B is detected in response to detection information concerning the outer wall surface 1B by the forward and rearward position detection sensors 24 on the left and right sides (S3). On the basis of the detected relative position of the holding unit 20 with respect to the outer wall surface 1B, the holding unit 20 is pivoted to a position parallel to the outer wall surface 1B and the holding unit 20 is also moved forwardly or rearwardly while maintaining its posture to bring the holding unit 20 to a predetermined position (i.e., a position where the holding guides 22 are placed above a line extending leftward and rightward from the guide grooves 3) (S4). In other words, as shown in FIGS. 13A and 13B, by moving the holding unit 20 forwardly or rearwardly while maintaining its posture, an inclination angle alpha of the holding unit 20 with respect to the outer wall surface 1B and the position (coordinates) of the outer wall surface 1B can be calculated from (1) difference Y in coordinates in the forward and rearward direction at which the forward and rearward position detection sensors 24 of the left and right sides has detected or ceased to detect the building 1 (i.e., the outer wall surface 1B) and (2) the interval S between the two sensors 24. On the basis of the detected inclination angle alpha and the coordinates of the outer wall surface 1B, the holding unit 20 is pivoted about the third axis to a position at which the holding unit 20 is parallel to the outer wall surface 1B and, as shown in FIG. 14, the holding guides 22 of the holding unit 20 are brought to a position above the line extending leftward and rightward from the guide grooves 3 of the building 1 by rotation of the rotary body 11B about the first axis and pivoting of the pivotable arm 12 about the second axis. In the state where the holding unit 20 has been positioned in the forward and rearward direction, the left and right position detection sensors 25 located at the sides of the holding guides 22 are also located above the line extending leftward and rightward from the guide grooves 3.

Figure 15:
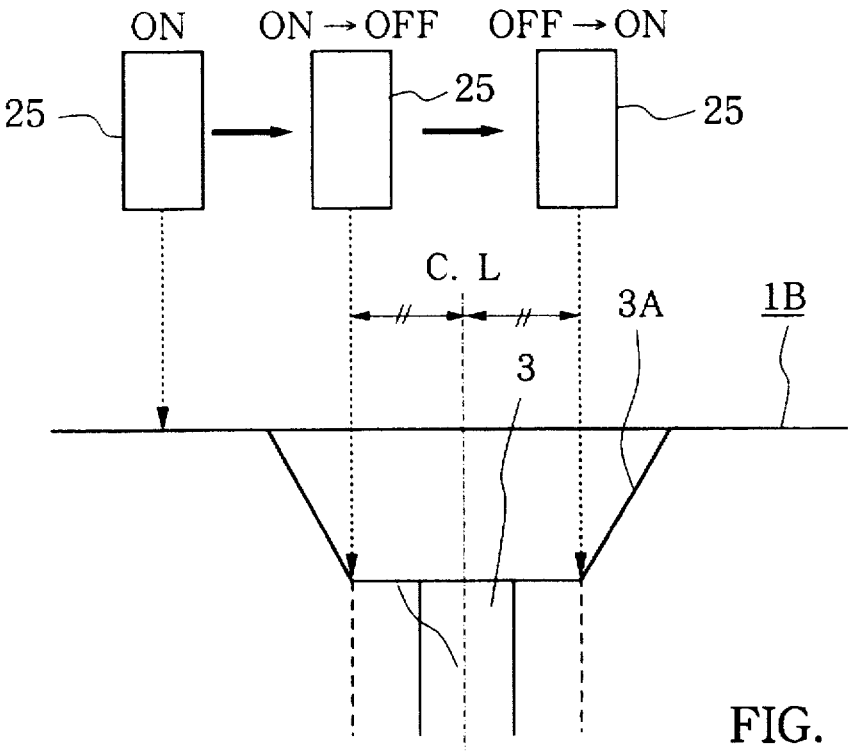
FIG. 15 is a view for explaining about a manner of detecting a position of the device in a lateral direction in lateral positioning.

For positioning of the holding unit 20 in the leftward and rightward direction, the holding unit 20 thus having been positioned in the forward and rearward direction is moved in parallel to the outer wall surface 1B of the building 1 while maintaining its posture and coordinates in the leftward and rightward direction of the guide grooves 3 are detected in response to guide groove detection information by the left and right position detection sensors 25 (the guide grooves 3 can be detected by cease of detection of the building 1) (S5). The holding guides 22 are moved in parallel in the leftward and rightward direction and stopped at a position where the holding guides 22 are aligned with the guide grooves 3 (S6). In other words, as shown in FIG. 14, by moving the holding unit 20 in parallel to the outer wall surface 1B of the building 1, the left and right position detection sensors 25 provided at the sides of the holding guides 22 and facing downward cease, as shown in FIG. 15, to produce a detection signal when its detection range has reached the guide grooves 3 and produces the detection signal again when the detection range has moved out of the guide grooves 3. Therefore, by picking up a coordinate in the middle of a coordinate at which the detection signal has ceased and a coordinate at which the detection signal has been produced again, a coordinate of the center C.L of each guide groove 3 is obtained and the holding guides 22 are positioned so that the holding guides 22 are aligned with the center coordinate C. L of the guide grooves 3.

After completion of the positioning of the holding unit 20 in the forward and rearward direction and the leftward and rightward direction and resulting alignment of the holding guides 22 with the guide grooves 3, the winding device 11D is operated to feed out the wire ropes 4 and thereby to lower the outer wall working machine 40 (S7).

As the outer wall working machine 40 is lowered, the connecting members 23 project from the lower ends of the holding guides 22 and, in advance to the movement of the fitting and moving members 41, the connecting portions 23B of the connecting members 23 are engaged in the connecting openings 3A of the guide grooves 3 as shown in FIGS. 16 and 17 whereby the holding guides 22 are connected with the guide grooves 3 via the connecting members 23. Whether or not the connecting portions 23B of the connecting members 23 are correctly engaged in the connecting openings 3A of the guide grooves 3 is judged by a detection signal from the connection sensor 26B (S8). More specifically, when a projection 23H detection signal is supplied from the connection sensor 26B, the routine proceeds to a next step on the assumption that the connecting portions 23B of the connecting members 23 are correctly engaged in the connecting openings 3A of the guide grooves 3 whereas when the projection 23H detection signal is not supplied from the connection sensor 26B, it is assumed that the connecting portions 23B of the connecting members 23 are not engaged in the connecting openings 3A of the guide grooves 3 and the lowering of the outer wall working machine 40 is stopped (S9) and then the outer wall working machine 40 is lifted to a predetermined position (S10) and held in the stand-by state by the holding unit 20 (S11). Then, the positioning routine is repeated from the above described step S3.

When the projection 23H detection signal is supplied from the connection sensor 26B and it is thereby judged that the connecting portions 23B of the connecting members 23 are engaged in the connecting openings 3A of the guide grooves 3, lowering of the outer wall working machine 40 is continued and, when the outer wall working machine 40 has reached a position facing the outer wall surface 1B of the building 1, the outer wall working machine 40 starts work on the outer wall surface 1B (S12) and continues the work by continuing lowering.

When the outer wall working machine 40 has reached the lower end of the building 1, the work and lowering of the outer wall working machine 40 are stopped (S13, S14) and the outer wall working machine 40 is lifted (S15) and held by the holding unit 20 (S16). The routine returns to the step Si and, by driving of the movable body 11, the suspension support device 10 is moved to a next work area to repeat the positioning and subsequent processings.

Figure 18:
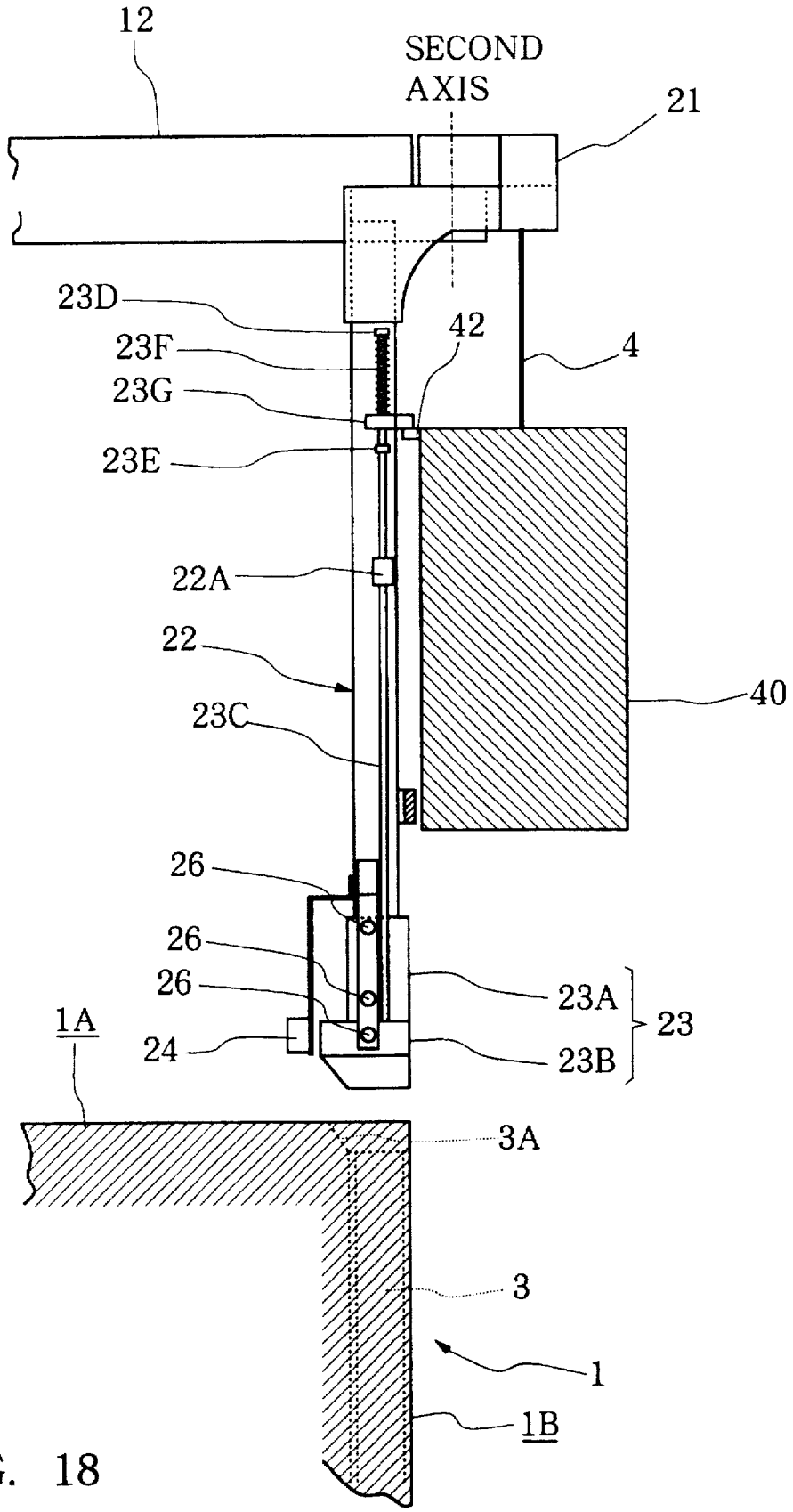
FIG. 18 is a side elevation of the holding guides showing a state where the outer wall working machine has been lifted excessively.
Figure 19:
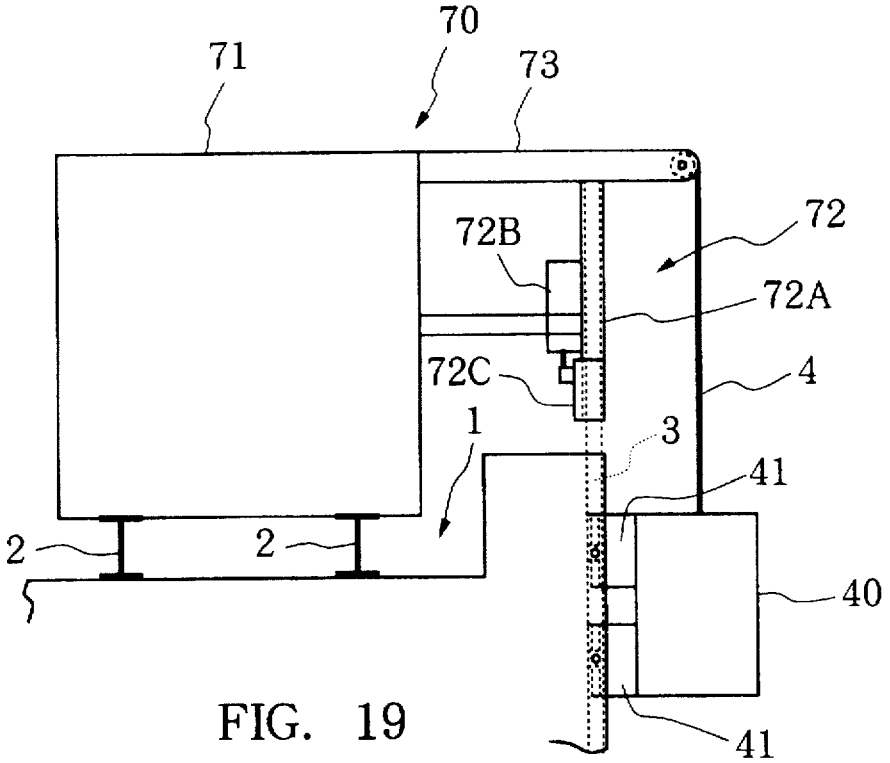
FIG. 19 PRIOR ART
FIG. 19 is a schematic view showing a prior art suspension support device.
Figure 20:
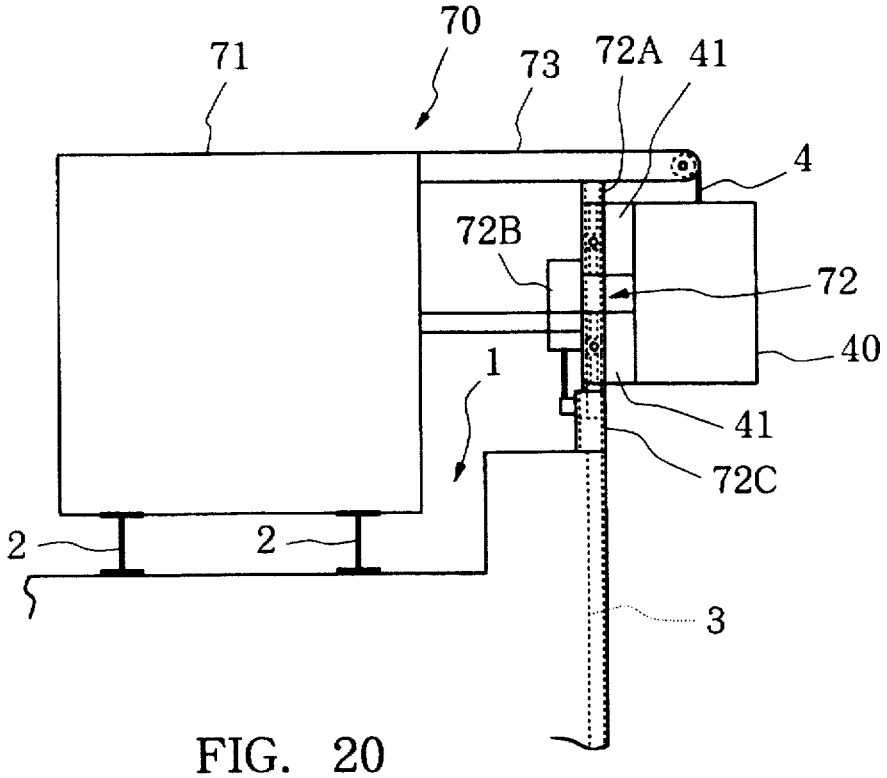
FIG. 20 PRIOR ART
FIG. 20 is a schematic view showing the suspension support device of FIG. 19 in a state holding an outer wall working machine in its holding unit.

For holding of the outer wall working machine 40 by the holding unit 20, the outer wall working machine 40 is lifted and the fitting and moving members 41 thereof move from the guide grooves 3 of the building 1 to the holding guides 22 via the connecting members 23 and thereafter the actuators 42 of the outer wall working machine 40 abut against the actuating levers 23G of the slide bars 23C. As the outer wall working machine 40 is lifted further, the actuating levers 23G (i.e., the connecting members 23) are pushed up by the actuators 42 and, accordingly, the connecting ends 23B of the connecting members 23 are brought out of engagement with the upper openings 3A of the guide grooves 3. When the outer wall working machine 40 is lifted to a predetermined position, as shown in FIGS. 4 and 5, the outer wall working machine 40 is received on the holding guides 22 and there is provided a predetermined interval between the lower surface of the connecting ends 23B and the upper surface 1A of the building 1. Therefore, the connecting members 23 do not interfere with the building 1 and do not prevent movement of the suspension support device 10. When the outer wall working machine 40 is lifted beyond the predetermined position for some reason, the connecting members 23 cannot be lifted further because this predetermined position is the upper limit position of the connecting members 23. In this case, as shown in FIG. 18, the actuating levers 23G slide against the slide bars 23C by compressing the coil springs 23F whereby application of an excessive upward force to the connecting members 23 can be prevented.

When rotation of the rotary body 11B about the first axis, pivoting of the pivotable arm 12 about the second axis and rotation of the holding unit 20 about the third axis are carried out in the state where the outer wall working machine 40 is held by the holding unit 20, there can be a case where length of wire ropes 4 change slightly depending upon design of the device 10 but in this case also, the outer wall working machine 40 will be permitted to be lifted or lowered to cope with such change of the length of the wire ropes 4 owing to elastic deformation of the coil springs 23F.

In the above described embodiment, for moving the holding unit 20 in the forward and rearward direction as well as in the leftward and rightward direction, the rotary body 11B is rotated about the first axis, the pivotable arm 12 is pivoted about the second axis, and the holding unit 20 is rotated about the third axis with respect to the pivotable arm 12. The structure of the holding unit 20, however, is not limited to this but it may be other structure if the holding unit 20 can be moved while maintaining its posture in the forward and rearward direction as well as in the leftward and rightward direction. For example, a stretchable arm may be provided on the rotary body 11B and the holding unit 20 may be supported at the foremost end thereof in such a manner that the holding unit can be pivoted about a vertical axis.

In the above described embodiment, the independent sensors (i.e., forward and rearward position detection sensors 24 and left and right position detection sensors 25) are provided for detecting the forward and rearward position and the leftward and rightward position of the holding unit 20. The arrangement of the sensors is not limited to this but a single sensor may be used commonly for detecting the forward and rearward position and the leftward and rightward position of the holding unit 20.

What is claimed is:

1. A suspension support device provided movably on the upper surface of a building for suspending, by means of ropes, an outer wall working machine having fitting and moving members which can be fittedly engaged in a pair of guide grooves formed vertically on an outer wall surface of the building, and lowering and lifting the outer wall working machine along the guide grooves comprising:

a main body;

an arm structure connected to the main body;

a holding unit connected to the arm structure in a manner to be movable forwardly and rearwardly, laterally and pivotable about a vertical axis and including a pair of holding guide members provided at an interval equal to an interval of the pair of guide grooves and being capable of receiving the fitting and moving members;

arm structure drive means for driving the arm structure to move the holding unit;

sensor means provided at both sides of the holding unit at positions corresponding to the holding guide members for detecting the upper edge of the building; and drive control means for controlling driving of the arm structure drive means in response to detection information supplied by the sensor means, said drive control means controlling driving of the arm structure to move the holding unit in a direction perpendicular to the outer wall surface while maintaining the posture of the holding unit, calculate angle and position of the holding unit with respect to the outer wall surface in response to the detection information concerning the outer wall surface supplied by the sensor means, move the holding unit to a position which is parallel to the outer wall surface and coincidental with the guide grooves in a direction perpendicular to the outer wall surface and thereafter move the holding unit in a direction parallel to the outer wall surface in a horizontal plane while maintaining the posture of the holding unit and, responsive to the detection information concerning the guide grooves supplied by the sensor means, bring the holding unit to a position at which the holding guide members align with the guide grooves.

2. A suspension support device as defined in claim 1 wherein the lower ends of the holding guide members of the holding unit are spaced from the upper edge of the building by a predetermined distance and said holding unit further comprises connecting members provided vertically slidably in the lower portion of the holding guide members to project from and withdraw into the holding guide members and thereby connect and disconnect the holding guide members with the guide grooves of the building and said holding unit further comprises actuator means connected to the connecting members, said connecting members being withdrawn into the holding guide members by operation of the actuator means by the outer wall working machine when the outer wall working machine is lifted and held by the holding guide members and said connector members projecting from the holding guide members when the outer wall working machine is lowered from the holding guide members to the outer wall surface of the building and thereby connecting the holding guide members with the guide grooves.

3. A suspension support device as defined in claim 2 wherein said holding unit further comprises a spring provided between the connecting members and the actuator means for permitting, by elastic deformation of the spring, vertical movement of the outer wall working machine in a state where the connecting members are withdrawn and received in the the holding guide members.

* * * * *